US010563923B2

(12) United States Patent
Middleton et al.

(10) Patent No.: US 10,563,923 B2
(45) Date of Patent: Feb. 18, 2020

(54) COOLING SYSTEMS AND METHODS FOR THERMOELECTRIC POWER GENERATION

(71) Applicant: National Technology & Engineering Solutions of Sandia, LLC, Albuquerque, NM (US)

(72) Inventors: Bobby Middleton, Albuquerque, NM (US); Matthew D. Carlson, Albuquerque, NM (US); Marie Y. Arrieta, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 16/214,382

(22) Filed: Dec. 10, 2018

(65) Prior Publication Data

US 2020/0025449 A1 Jan. 23, 2020

Related U.S. Application Data

(63) Continuation of application No. 15/666,395, filed on Aug. 1, 2017, now Pat. No. 10,184,726.

(60) Provisional application No. 62/370,097, filed on Aug. 2, 2016.

(51) Int. Cl.

| | |
|---|---|
| ***F28B 9/06*** | (2006.01) |
| ***F28F 27/00*** | (2006.01) |
| ***F01K 7/00*** | (2006.01) |
| ***F28D 15/00*** | (2006.01) |
| ***F01K 9/00*** | (2006.01) |
| ***F28B 1/00*** | (2006.01) |
| ***F28D 15/02*** | (2006.01) |
| ***F01K 7/16*** | (2006.01) |
| *F28B 1/06* | (2006.01) |
| *F28C 1/00* | (2006.01) |

(52) U.S. Cl.

CPC ..... *F28B 9/06* (2013.01); *F01K 7/00* (2013.01); *F01K 7/16* (2013.01); *F01K 9/00* (2013.01); *F01K 9/003* (2013.01); *F28B 1/00* (2013.01); *F28D 15/00* (2013.01); *F28D 15/0266* (2013.01); *F28F 27/00* (2013.01); *F28B 2001/065* (2013.01); *F28C 2001/006* (2013.01)

(58) Field of Classification Search

CPC ..... F28B 9/06; F28B 2001/065; F28B 1/00; F01K 9/003; F01K 7/16; F01K 7/00; F01K 9/00; F28D 15/0266; F28D 15/00; F28F 27/00; F28C 2001/006

See application file for complete search history.

(56) References Cited

U.S. PATENT DOCUMENTS

2009/0093917 A1* 4/2009 Smith ..... F25B 49/005 700/300
2013/0327078 A1* 12/2013 Junge ..... F25B 5/02 62/335

* cited by examiner

*Primary Examiner* — Emmanuel E Duke
(74) *Attorney, Agent, or Firm* — Daniel J. Jenkins

(57) ABSTRACT

Systems and methods for cooling a power generation working fluid are disclosed that reduce the amount of cooling fluid used. These systems and methods save on water usage in the generation of power by thermoelectric power generation systems.

15 Claims, 2 Drawing Sheets

- Eliminates wet cooling tower; replaces with air coolers.
- Eliminates pumps in cooling cycle.

COOLING SYSTEMS AND METHODS FOR THERMOELECTRIC POWER GENERATION

RELATED APPLICATION

This application is a Continuation of U.S. patent application Ser. No. 15/666,395, entitled "COOLING SYSTEMS AND METHODS FOR THERMOELECTRIC POWER GENERATION," filed Aug. 1, 2017, which claims priority to U.S. Provisional Patent Application No. 62/370,097, filed on Aug. 2, 2016, entitled "COOLING SYSTEMS AND METHODS," the entireties of which are incorporated herein by reference.

STATEMENT OF GOVERNMENT INTEREST

The United States Government has rights in this invention pursuant to Contract No. DE-AC04-94AL85000 between the United States Department of Energy and Sandia Corporation, and Contract No. DE-NA0003525 between the United State Department of Energy and National Technology & Engineering Solutions of Sandia, LLC, both for the operation of the Sandia National Laboratories.

FIELD

The present disclosure is generally directed to cooling systems and methods for thermoelectric power generation.

BACKGROUND

Current cooling systems use large amounts of water in the operation of the cooling process. For example, most steam power plants utilize a Cooling Water System (CWS) that transfers heat from working steam to the water in the CWS. The water in the CWS is typically then cool by either evaporating the water in cooling towers resulting in a large amount of water loss or by using once-through cooling with heat exchangers using a large volume of available water, such as a river, lake or estuary source. Once-through cooling causes surface water to be drawn from a source (river, lake, etc.), heated, then returned to the source, causing environmental impact.

As water becomes a more valuable commodity, a need remains, therefore, for systems and methods for water saving cooling systems and methods.

SUMMARY OF THE DISCLOSURE

The present disclosure is directed to systems and methods for cooling thermoelectric power generation systems.

According to an embodiment of the disclosure, a cooling system is disclosed that includes a first condenser, an evaporator in fluid communication with the first condenser, and a second condenser in fluid communication with the evaporator. The first condenser is configured to receive and discharge a working fluid. The evaporator is configured to receive and discharge a refrigerant. The first condenser is further configured to exchange heat between the working fluid and the refrigerant. The second condenser is configured to receive and discharge air. The second condenser and evaporator are configured to circulate a zeotropic refrigerant by natural circulation therebetween thereby transferring heat from the refrigerant to the air According to another embodiment of the disclosure, a method for cooling a working fluid is disclosed that includes removing heat from a working fluid by exchanging heat with a refrigerant, removing heat from the refrigerant by exchanging heat with a zeotropic refrigerant. And removing heat from the zeotropic refrigerant by exchanging heat with air. The zeotropic fluid is naturally circulated between exchanging heat with the refrigerant and the air According to another embodiment of the disclosure, a cooling system is disclosed that includes a first condenser, an evaporator in fluid communication with the first condenser, a second condenser in fluid communication with the evaporator, and a cooling device in fluid communication with the first condenser. The first condenser is configured to receive and discharge a working fluid. The evaporator is configured to receive and discharge cooling water. The first condenser is further configured to exchange heat between the working fluid and the cooling water. The condenser is in fluid communication with a condenser discharge line that is in fluid communication with the cooling device. The condenser discharge line includes an evaporator bypass line that is in fluid communication with the evaporator. The evaporator bypass line rejoins the condenser discharge line after leaving the evaporator. The cooling device is in fluid communication with a cooling device return line that provides cooling water back to the first condenser. The second condenser is configured to receive and discharge air. The second condenser and evaporator are configured to circulate a zeotropic refrigerant by natural circulation therebetween thereby transferring heat from the cooling water to the air.

According to another embodiment of the disclosure, a method for cooling a working fluid is disclosed that includes removing heat from a working fluid by exchanging heat with a cooling fluid, removing heat from the cooling fluid by exchanging heat from a first portion of the cooling fluid with a zeotropic refrigerant, removing heat from the zeotropic refrigerant by exchanging heat with air, and returning the first portion of the cooling fluid to the cooling fluid after exchanging heat with the zeotropic refrigerant and then providing the cooling fluid to a cooling device. The zeotropic fluid is naturally circulated between exchanging heat with the refrigerant and the air.

An advantage of the present disclosure is to reduce or eliminate water consumption in a cooling process.

Another advantage of the present disclosure is to decrease the amount of water required to cool a thermoelectric power plant.

Other features and advantages of the present disclosure will be apparent from the following more detailed description of the preferred embodiment, taken in conjunction with the accompanying drawings which illustrate, by way of example, the principles of the disclosure.

DETAILED DESCRIPTION

Figure 1:
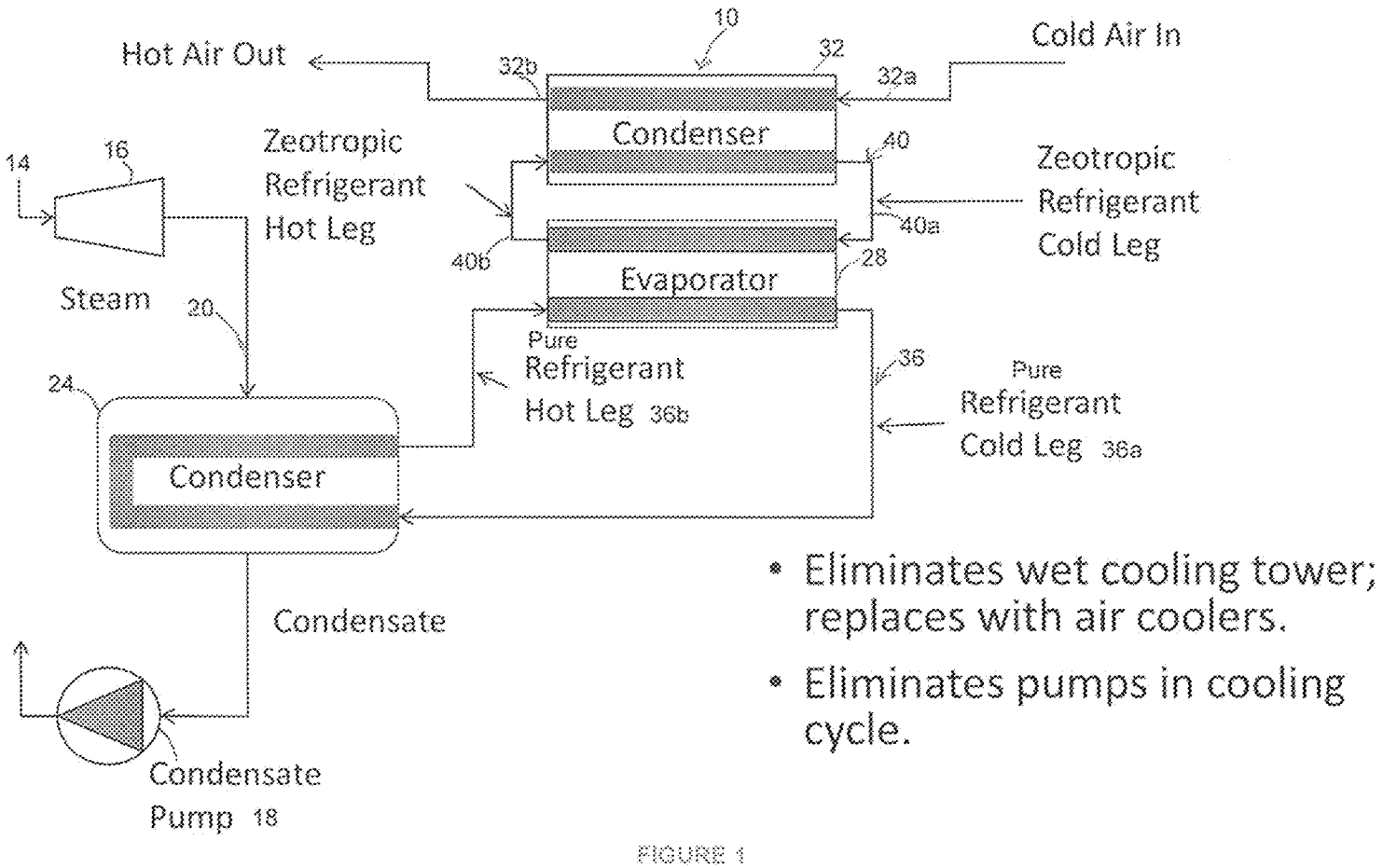
FIG. 1 illustrates a cooling system according to an embodiment of the disclosure.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art.

The present invention is directed to using a naturally circulated zeotropic refrigerant as a cooling loop or cycle in a thermoelectric power generation system (power system). In an embodiment, the zeotropic refrigerant loop cools a working fluid of the power system. In another embodiment, the zeotropic refrigerant loop cools a coolant used to cool a working fluid.

According to an embodiment of the disclosure, supercritical (SC) natural circulation (NC) cooling fluid systems and methods are disclosed. The SC NC system utilizes a supercritical fluid that requires no external source of power to force circulation. Heat is transferred via heat exchanger from the source (e.g., the steam exiting a turbine in a steam Rankine power conversion cycle) to the supercritical fluid. This heat is then transferred via heat exchanger to the ultimate heat sink (e.g., air circulated through a cooling tower). The particular fluid being used will differ, dependent upon matching the thermodynamic properties of the fluid to the ultimate heat sink conditions (e.g., temperature and humidity of the air if heat is transferred to air).

The SC NC system replaces conventional CWSs with a closed refrigerant that may or may not be in a supercritical state at its coldest point. However, the refrigerant will be supercritical at its hottest point. This is to ensure that the maximum benefit of natural circulation can be extracted, thereby minimizing the external power needed to circulate the fluid. The particular refrigerant used will be chosen in such a way as to match the ambient conditions to which the heat is transferred and to minimize any efficiency losses to the power conversion system.

According to another embodiment of the disclosure, cooling systems and methods are disclosed that include a zeotropic thermosiphon for cooling. In an embodiment, the system and methods may include naturally-circulated systems utilizing a zeotropic mixture of refrigerants to precool a portion of the cooing water before the cooling water is cooled via heat transfer to the ultimate heat sink. Heat from a portion of the cooling water is utilized to boil the zeotropic refrigerant mixture. This mixture is then cooled via heat transfer to air in an air-side heat exchanger. A zeotropic mixture can increase in temperature as it boils, whereas current technology utilizes a single refrigerant, which boils at a constant temperature. A zeotropic mixture allows for optimization of the temperature difference between the cooling water and the refrigerant. Current technology requires that this temperature difference decrease across the length of the heat exchanger, thereby decreasing heat transfer effectiveness. Thus, the zeotropic thermosiphon increases overall cycle heat transfer effectiveness and decreases the amount of water needed to cool the power plant.

In an embodiment, a thermosiphon can be used to precool a portion of the cooling water before it is routed to the cooling tower or to the original source (in the case of once-through cooling). To utilize a thermosiphon, a portion of the cooling water is routed to a heat exchanger with a refrigerant on the cold side of the heat exchanger. The refrigerant is heated and boils. The refrigerant vapor is then cooled via heat transfer to the air. The net result is that the water routed to the ultimate heat sink (cooling tower or original water source) is cooler than it would be without the pre-cooling phase. This means that less heat is transferred to the ultimate heat sink. In the case of cooling towers, this means less water is evaporated. In the case of once-through cooling, this means that the original water source is not heated as much. Current technology utilizes a single refrigerant. This means that the refrigerant boils at a constant temperature. However, the water from which the heat is transferred is being cooled as it passes through the heat exchanger. Thus, the temperature difference between the cooling water and the refrigerant decreases over the length of the heat exchanger. Since heat transfer rate is proportional to this temperature difference, the effectiveness of the heat exchanger decreases as from the water entrance to the water exit.

Zeotropic mixtures of refrigerants are used. A zeotropic mixture of refrigerants is a mixture of two or more refrigerants with different boiling points at the same pressure. This means that the more volatile refrigerant will boil before the less volatile. Thus, the boiling temperature of the mixture increases as more refrigerant is evaporated. Utilizing this principle, a heat exchanger can be designed that maintains a refrigerant temperature profile that is similar to that of the water being cooled, thereby maintaining a constant temperature difference across the heat exchanger. This will allow for a more effective heat transfer process. There are two possible net effects. The first is that the water is cooled to a lower temperature before being routed to the ultimate heat sink. This would require less water to cool the plant. An alternative is to cool the water at the same temperature that it would be cooled using current thermosiphon technology. However, this would allow a lower temperature at which heat is transferred to the cooling water from the power conversion system, thereby increasing overall power plant efficiency. Either use of the zeotropic thermosiphon would result in a more water-efficient power generating station. FIG. 3 illustrates a hybrid system with thermosiphon zeotropic cooling according to an embodiment of the disclosure.

The following embodiments propose different types of cooling configurations possible for power plants. The first and most common is indirect cooling where the power cycle working fluid, such as steam or supercritical carbon dioxide, is cooled by liquid water in an intermediate loop. This intermediate cooling loop water is then later cooled by air (indirect dry cooling) or by humidified air (evaporative cooling) in a cooling tower. The second configuration is direct cooling, where the power cycle working fluid is directly cooled by air or humidified air. Finally, the third configuration involves a hybrid of these two systems where part of the cooling load is handled directly and part is handled indirectly.

These embodiments propose the use of alternate fluids, such as supercritical fluids or refrigerants and mixtures, to improve the heat transfer process between either the working cycle fluid and air in a direct cooling configuration or between the intermediate cooling loop fluid and air in an indirect cooling configuration. Embodiments where alternate fluids are used to improve performance in hybrid systems are also possible.

There are two fundamental challenges with current power plant cooling that these approaches are able to address. The first is that power cycle working fluids are either condensed or cooled during the cooling process at a constant or near-constant temperature, while the temperature of the air used to either directly or indirectly cool the working fluid increases as the working fluid cools. This difference in temperature behavior as heat is transferred leads to thermodynamic losses in the heat exchangers or a power plant and limits the efficiency of a dry-cooled plant. The alternate working fluids proposed can have different temperature behavior as they transfer heat, allowing them to better match the behavior of both the power cycle working fluid and the air in order to increase the efficiency of a dry-cooled plant. The second challenge is that the intermediate water loop pump and the fans used in the cooling towers both require electrical power to operate. This power consumption can be significant, and limits the ultimate output of the plant as some of the power generated is consumed on-site. The alternate fluids proposed can have very strong natural circulation driving potentials, allowing them to transfer heat without the need for a pump or with reduced operational power requirements, and the increased heat transfer performance with air allows for lower air speeds and therefore lower fan power.

Two types of alternate fluids are proposed. The first type includes supercritical fluids or mixtures such as supercritical carbon dioxide. These fluids can have different temperature behavior during heat transfer, as characterized by their isobaric specific heat capacity, depending on their pressure allowing them to act as an intermediate fluid well-matched to transfer heat between the power cycle working fluid and air. The second type include zeotropic fluids, each of which are a mixture of multiple fluids such that for a given pressure the saturation temperature of the mixture will change as it evaporates or condenses. This creates a temperature difference between the saturated liquid and saturated vapor conditions of the fluid mixture for a given pressure called a "glide" temperature, allowing for more effective heat exchange with single-phase fluids such as liquid cooling water and atmospheric pressure air. This behavior is also affected by the operating pressure of the zeotropic intermediate loop.

The specific fluid used in a dry cooling system depends on the cooling temperature of the power cycle working fluid and the ambient air temperature. In the case of supercritical fluids or mixtures, the fluid is selected or the mixture designed so that the critical temperature falls somewhere between the power cycle cooling temperature and the ambient air temperature. In some cases, such as with supercritical carbon dioxide, the critical temperature of approximately 31° C. is well-positioned for a steam power plant in cooler climates. However, in warmer climates the carbon dioxide can be mixed with hydrocarbons such as methane, ethane, propane, pentane, sulfur hexafluoride, and others to lower the critical temperature. Alternatively, the carbon dioxide can be mixed with butane or hexane to increase the critical temperature to achieve a better match.

In the case of zeotropic fluids, the mixture composition and pressure can both be varied to better match the operating conditions of the dry cooling system. Mixtures containing fluids with a greater difference in boiling points will have a larger glide temperature, such as a mixture of R152a and R245fa, while a higher relative pressure (the ratio of the operating pressure to the critical pressure) can decrease the glide temperature as well as the natural circulation potential.

FIG. 1 illustrates a cooling system 10 installed in a thermoelectric power generation system (power system) 14 according to an embodiment of the invention. In this embodiment, the power system 14 includes a turbine 16 and a condensate pump 18, but it is understood that these are only two components of a multi-component power system for which other components, such as but not limited to an electrical generator or motor, are not shown. In this exemplary embodiment, the discharge line 20 from the turbine 16 is a steam discharge line, however, in other embodiments the discharge line 20 may discharge any working fluid, such as, but not limited to steam and supercritical fluids. In an embodiment, the supercritical fluid may be supercritical carbon dioxide.

The cooling system 10 includes a first condenser 24, an evaporator 28 and a second condenser 32. The first condenser 24 receives steam from the discharge line 20 and exchanges heat with a refrigerant loop 36. The refrigerant loop 36 includes a refrigerant loop cold leg or line 36*a* and a refrigerant loop hot leg or line 36*b*. The refrigerant loop cold line 36*a* provides a refrigerant to the first condenser 24 where the refrigerant is heated by the steam, thereby transferring heat to the refrigerant and cooling the steam to a condensate. The heated refrigerant is then provided to the evaporator 28 via the refrigerant loop hot line 36*b*.

At the evaporator 28, heat from the refrigerant is transferred to a zeotropic refrigerant loop 40. The zeotropic refrigerant loop 40 includes a zeotropic refrigerant cold leg or line 40*a* and a zeotropic refrigerant hot leg or line 40*b*. The heated zeotropic refrigerant discharged from the evaporator 28 via the zeotropic refrigerant hot line 40*b* is provided to the condenser 32 where it is cooled by exchanging heat with air and then discharged to the zeotropic refrigerant cold line 40*a* and provided back to the evaporator 28. The zeotropic refrigerant is circulated in the zeotropic refrigerant loop 40 by natural circulation caused by the heating and cooling of the zeotropic fluid in the loop. In an embodiment, the condenser 32 is disposed or positioned above the evaporator 28 to facilitate natural circulation.

At the condenser 32, heat from the zeotropic refrigerant is transferred to air provided to the condenser 32 via an air intake 32*a*, where the air is heated by the zeotropic refrigerant, cooling the refrigerant, and then discharged via an air discharge 32*b*.

The cooling system and associated method described above for the embodiment of FIG. 1 may be referred to as "dry cooling" as no fluid, such as water, is needed from a source outside of the cooling system.

Figure 2:
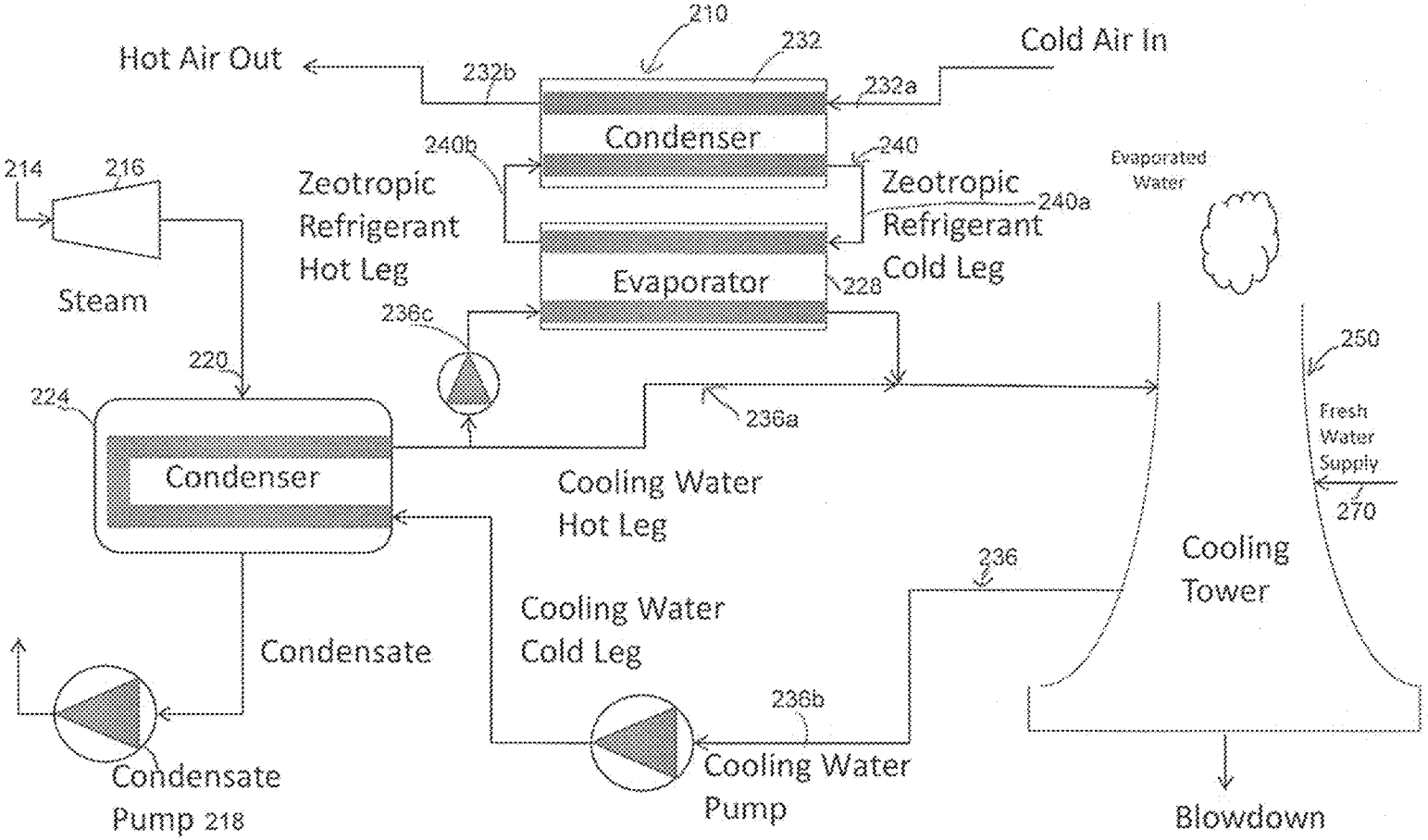
FIG. 2 illustrates a cooling systems according to another embodiment of the disclosure.

FIG. 2 illustrates another cooling system 210 installed in a thermoelectric power generation system (power system) 214 according to an embodiment of the invention. In this embodiment, the power system 214 includes a turbine 216 and a condensate pump 218, but it is understood that these are only two components of a multi-component power system for which other components, such as but not limited to an electrical generator or motor, are not shown. In this exemplary embodiment, the discharge line 220 from the turbine 216 is a steam discharge line, however, in other embodiments the discharge line 220 may discharge any working fluid, such as, but not limited to steam and supercritical fluids. In an embodiment, the supercritical fluid may be supercritical carbon dioxide.

The cooling system 210 includes a first condenser 224, an evaporator 228 and a second condenser 232. The first condenser 224 receives steam from the discharge line 220 and exchanges heat with a coolant loop 236. The coolant loop 236 includes a coolant loop hot leg or line 236*a* and a coolant loop cold leg or line 236*b*. The coolant loop hot line 236*a* includes a coolant loop hot line bypass 236*c* that provides coolant to the evaporator 228, where coolant in the coolant loopy bypass 236*c* is cooled by exchanging heat with a zeotropic refrigerant cooling loop 240 before it is rejoined with the coolant loop hot line 236*a*. In this exemplary embodiment, the coolant is water.

The coolant loop hot line 236*a* provides coolant to a cooling device 250. In this exemplary embodiment, the cooling device 250 is a cooling tower. At the cooling tower 250, the coolant is cooled by exchanging heat with the environment through mostly evaporative cooling, whereupon the cooled coolant is returned to the condenser via the coolant loop cold line 236*b*. The cooling device 250 receives additional coolant to replace coolant lost to evaporation from a coolant input source 270.

As discussed above, heat from the coolant is transferred to the zeotropic refrigerant loop 240 at the evaporator 228. The zeotropic refrigerant loop 240 includes a zeotropic refrigerant cold leg or line 240*a* and a zeotropic refrigerant hot leg or line 240*b*. The heated zeotropic refrigerant discharged from the evaporator 228 via the zeotropic refrigerant hot line 240*b* is provided to the condenser 232 where it is cooled by exchanging heat with air and then discharged to the zeotropic refrigerant cold line 240*a* and provided back to the evaporator 228. The zeotropic refrigerant is circulated in the zeotropic refrigerant loop 240 by natural circulation caused by the heating and cooling of the zeotropic fluid in the loop. In an embodiment, the condenser 232 is disposed or positioned above the evaporator 228 to facilitate natural circulation.

At the condenser 232, heat from the zeotropic refrigerant is transferred to air provided to the condenser 232 via an air intake 232*a*, where the air is heated by the zeotropic refrigerant, cooling the refrigerant, and then discharged via an air discharge 232*b*.

The cooling system and associated method described above for the embodiment of FIG. 12 may be referred to as "a hybrid cooling cycle" as the amount of fluid, such as water, needed from a source outside of the cooling system is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the appended claims. It is intended that the scope of the invention be defined by the claims appended hereto. The entire disclosures of all references, applications, patents and publications cited above are hereby incorporated by reference.

In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A method for cooling a working fluid, comprising:
removing heat from a working fluid by exchanging heat with a refrigerant in a first condenser;
removing heat from the refrigerant by exchanging heat with a zeotropic refrigerant in an evaporator; and
removing heat from the zeotropic refrigerant by exchanging heat with air in a second condenser;
wherein the zeotropic fluid is naturally circulated between exchanging heat with the refrigerant and the air.

2. The method of claim 1, wherein the working fluid is water.

3. The method of claim 1, wherein the working fluid is circulated in a steam power cycle.

4. The method of claim 1, wherein the working fluid is a supercritical fluid.

5. The method of claim 4, wherein the supercritical fluid is supercritical carbon dioxide.

6. The method of claim 4, wherein the supercritical fluid is circulated within a power generation cycle.

7. A method for cooling a working fluid, comprising:
removing heat from a working fluid by exchanging heat with a cooling fluid in a first condenser;
removing heat from the cooling fluid by exchanging heat from a first portion of the cooling fluid with a zeotropic refrigerant in an evaporator;
removing heat from the zeotropic refrigerant by exchanging heat with air in a second condenser; and
returning the first portion of the cooling fluid to the cooling fluid after exchanging heat with the zeotropic refrigerant and then providing the cooling fluid to a cooling device;
wherein the zeotropic fluid is naturally circulated between exchanging heat with the refrigerant and the air.

8. The method of claim 7, wherein the working fluid is water.

9. The method of claim 7, wherein the cooling fluid is water.

10. The method of claim 7, wherein the cooling device is a cooling tower.

11. The method of claim 7, further comprising:
adding additional cooling fluid from a cooling fluid source to the cooling fluid at the cooling device.

12. The method of claim 7, wherein the working fluid is circulated in a steam power cycle.

13. The method of claim 7, wherein the working fluid is a supercritical fluid.

14. The method of claim 13, wherein the supercritical fluid is supercritical carbon dioxide.

15. The method of claim 13, wherein the supercritical fluid is circulated within a power generation cycle.

* * * * *